US012043504B2

(12) United States Patent
Torigoe

(10) Patent No.: US 12,043,504 B2
(45) Date of Patent: Jul. 23, 2024

(54) ROLL BODY

(71) Applicant: LINTEC CORPORATION, Tokyo (JP)

(72) Inventor: Syouto Torigoe, Tokyo (JP)

(73) Assignee: LINTEC CORPORATION, Tokyo (JP)

( * ) Notice: Subject to any disclaimer, the term of this patent is extended or adjusted under 35 U.S.C. 154(b) by 212 days.

(21) Appl. No.: 17/771,541

(22) PCT Filed: Dec. 21, 2020

(86) PCT No.: PCT/JP2020/047635

§ 371 (c)(1),
(2) Date: Apr. 25, 2022

(87) PCT Pub. No.: WO2021/176804

PCT Pub. Date: Sep. 10, 2021

(65) Prior Publication Data

US 2022/0402717 A1 Dec. 22, 2022

(30) Foreign Application Priority Data

Mar. 5, 2020 (JP) ..... 2020-037442

(51) Int. Cl.
*B65H 18/28* (2006.01)

(52) U.S. Cl.
CPC ..... *B65H 18/28* (2013.01); *B65H 2511/17* (2013.01); *B65H 2515/40* (2013.01); *B65H 2701/1752* (2013.01)

(58) Field of Classification Search
CPC ..... B65H 18/28
See application file for complete search history.

(56) References Cited

FOREIGN PATENT DOCUMENTS

| | | |
|---|---|---|
| JP | 2011-178521 A | 9/2011 |
| JP | 2016-069168 A | 5/2016 |
| JP | 2018-058602 A | 4/2018 |

OTHER PUBLICATIONS

English machine translation for JP2011178521 (Sep. 15, 2011). (Year: 2011).*
International Search Report for PCT Patent App. No. PCT/JP2020/047635 (Feb. 2, 2021).

* cited by examiner

*Primary Examiner* — Michael C Miggins
(74) *Attorney, Agent, or Firm* — Future IP LLC; Tomoko Nakajima

(57) ABSTRACT

Provided is a roll body capable of effectively suppressing the occurrence of a telescope phenomenon even if the ambient temperature during transportation and storage of the roll body becomes higher than that during production of the roll body. A roll body RB according to the present invention configured by winding a belt-shaped web around a winding core that thermally expands or contracts due to an influence of a surrounding environment is characterized in that a linear expansion coefficient of the web in a thickness direction is in a range of 60 to 150 times a linear expansion coefficient of the web in a longitudinal direction, and the winding core has a linear expansion coefficient in a range of $20\times10^{-6}$/K to $100\times10^{-6}$/K and a Young's modulus in a range of 0.2 GPa to 0.5 GPa.

2 Claims, 2 Drawing Sheets

ROLL BODY

This application is a national phase entry under 35 U.S.C. § 371 of PCT Patent Application No. PCT/JP2020/047635, filed on Dec. 21, 2020, which claims priority under 35 U.S.C. § 119 to Japanese Patent Application No. 2020-037442, filed Mar. 5, 2020, both of which are incorporated by reference.

TECHNICAL FIELD

The present invention relates to a roll body configured by winding a belt-shaped web around a winding core (core) that thermally expands or contracts due to the influence of the surrounding environment.

BACKGROUND ART

It is generally known that a so-called telescope phenomenon occurs in which a web wound around a winding core is displaced in an axial direction and deformed into a bowl shape or a dish shape under the influence of a surrounding environment in a case where this type of roll body is transported or stored. Such a telescope phenomenon is considered to be caused by water absorbability or moisture absorbability of plastic or resin constituting the winding core. Therefore, it has been proposed that a wound body is packaged and transported or stored in a moisture-proof packaging film (see, for example, Patent Literature 1). However, it has been found that the occurrence of the telescope phenomenon may not be effectively suppressed only by packaging the wound body with a moisture-proof packaging film.

Therefore, the present inventor has conducted intensive studies, and has found the following. That is, during production of a roll body, a web is wound around a resin winding core while applying a constant tension. For example, in a case where the roll body thermally expands due to a higher ambient temperature during transportation and storage of the roll body than that during production of the roll body (+20° C. to +25° C.), the winding pressure of the web increases due to a difference between the thermal expansion of the winding core and the thermal expansion of the web in the thickness direction. It has been found that the above-described telescope phenomenon occurs due to the dispersion of the winding pressure that has been increased.

CITATION LIST

Patent Literature

Patent Literature 1: JP 2018-58602 A

SUMMARY OF INVENTION

Technical Problem

The present invention has been made based on the above findings. That is, an object of the present invention is to provide a roll body capable of effectively suppressing the occurrence of a telescope phenomenon even if the ambient temperature during transportation and storage of the roll body becomes higher than that during production of the roll body.

Solution to Problem

In order to solve the above problem, in the roll body according to the present invention configured by winding a belt-shaped web around a winding core that thermally expands or contracts due to the influence of the surrounding environment, the linear expansion coefficient of the web in the thickness direction is in the range of 60 to 150 times the linear expansion coefficient in the longitudinal direction. The winding core has a linear expansion coefficient in a range of $20\times10^{-6}$/K to $100\times10^{-6}$/K and a Young's modulus in a range of 0.2 GPa to 0.5 GPa. The present invention can be suitably applied in a case where a polyimide film having a width of 5 mm to 100 mm is used as the web.

Advantageous Effects of Invention

According to the present invention, a web having a linear expansion coefficient in the thickness direction of 60 to 150 times a linear expansion coefficient in the longitudinal direction is used as the web, and a winding core having a linear expansion coefficient in a range of $20\times10^{-6}$/K to $100\times10^{-6}$/K and a Young's modulus in a range of 0.2 GPa to 0.5 GPa is used as the winding core. Therefore, even in a case where the ambient temperature during transportation and storage of the roll body is higher than that during production of the roll body, it is possible to suppress an increase in the winding pressure of the web by minimizing the difference between the thermal expansion of the winding core and the thermal expansion of the web in the thickness direction as much as possible. As a result, the occurrence of a telescope phenomenon can be effectively suppressed.

DESCRIPTION OF EMBODIMENTS

Figure 1:
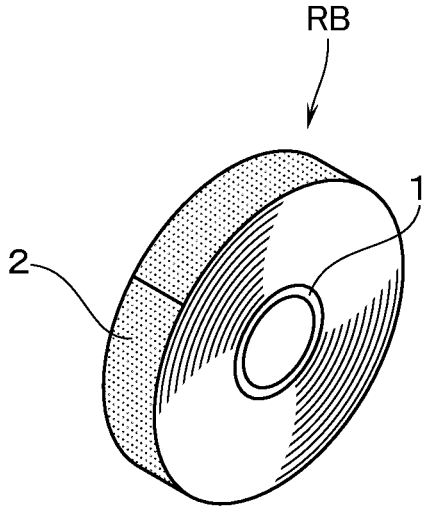
FIG. 1 is a perspective view illustrating an embodiment of a roll body of the present invention.

Hereinafter, an embodiment of a roll body of the present invention will be described with reference to the drawings. Referring to FIG. 1, RB is a roll body. The roll body RB includes a tubular winding core (core) 1 and a belt-shaped web 2 wound around the winding core 1.

Regarding the web 2, the linear expansion coefficient in the thickness direction is only required to be 60 to 150 times the linear expansion coefficient in the longitudinal direction. A plastic film, a plastic film with a pressure-sensitive adhesive layer formed on one surface of the plastic film, or a plastic film with a release film further provided on a surface of the pressure-sensitive adhesive layer can be used as the web 2. Examples of such a plastic film include a polyimide film. Note that the thickness of the web 2 is set to a range of 30 μm to 200 μm, for example, and the length of the web 2 in the longitudinal direction is set to a range of 100 m to 1000 m, for example. In addition, in a case where the width of the web 2 is, for example, in the range of 5 mm to 100 mm, the telescope phenomenon remarkably appears, and thus the present invention can be suitably applied. Note that the linear expansion coefficient in the thickness direction and the linear expansion coefficient in the longitudinal direction of the web 2 are measured by the method described in Examples described later.

The winding core 1 can be made of, for example, resin such as acrylonitrile butadiene styrene (ABS) resin or high density polyethylene (HDPE). The dimensions of the winding core 1 are appropriately set according to the width, length, and thickness of the web 2, the tension at the time of winding, and the like. For example, the length of the winding core 1 corresponding to the width of the web 2 can be set to a range of 0.005 m to 5 m, the outer diameter can be set to a range of 0.5 cm to 50 cm, and the wall thickness can be set to a range of 1 mm to 50 mm.

Incidentally, during production of the roll body RB, the web 2 is wound around the winding core 1 while applying a constant tension. For example, in a case where the roll body RB thermally expands due to a higher ambient temperature during transportation and storage of the roll body RB than that during production of the roll body RB (+20° C. to +25° C.), the winding pressure of the web 2 increases due to a difference between the thermal expansion of the winding core 1 and the thermal expansion of the web 2 in the thickness direction. The above-described telescope phenomenon occurs due to the dispersion of the winding pressure that has increased.

In the present embodiment, a web having a linear expansion coefficient in the thickness direction of 60 to 150 times the linear expansion coefficient in the longitudinal direction is used as the web 2. A winding core having a linear expansion coefficient in a range of $20\times10^{-6}$/K to $100\times10^{-6}$/K and a Young's modulus in a range of 0.2 GPa to 0.5 GPa is used as the winding core 1. Therefore, even if the ambient temperature during transportation and storage of the roll body RB is higher than that during production of the roll body RB, it is possible to suppress an increase in the winding pressure of the web 2 by minimizing the difference between the thermal expansion of the winding core 1 and the thermal expansion of the web 2 in the thickness direction as much as possible. As a result, the occurrence of a telescope phenomenon can be effectively suppressed. The linear expansion coefficient of the winding core 1 is more preferably in the range of $40\times10^{-6}$/K to $90\times10^{-6}$/K. The Young's modulus of the winding core 1 is more preferably in the range of 0.2 GPa to 0.4 GPa. Note that the winding speed of the web 2 during production of the roll body RB (at the time of winding the web 2) is not particularly limited, but is usually set in the range of 1 m/min to 100 m/min. The winding tension of the web 2 is not particularly limited, but is usually set in the range of 1 N/m to 300 N/m.

Next, Examples of the present invention will be described by using as an example a case where an adhesive tape in which a pressure-sensitive adhesive layer containing an acrylic acid ester copolymer is formed in a thickness of 8 μm on one surface of a polyimide film having a thickness of 25 μm is used as the web 2. The linear expansion coefficients of the web 2 in the longitudinal direction and the thickness direction were measured using a thermomechanical analyzer ("TMA 4000S" manufactured by NETZSCH Japan K.K.). That is, in accordance with Japanese Industrial Standards (JIS K 7197 2012) "Testing Method for Linear Thermal Expansion Coefficient of Plastics by Thermomechanical Analysis", thermal strain with respect to temperature was obtained, and the linear expansion coefficient was determined from the slope of the thermal strain. The test piece for measurement in the longitudinal direction had a length of 20 mm and a width of 5 mm, and measurement was conducted at a temperature raising rate of 5° C./min. The test piece for measurement in the thickness direction had a length of 8 mm, a width of 8 mm, and a thickness of 1 mm, and measurement was conducted at a temperature raising rate of 1° C./min. The linear expansion coefficient in the thickness direction thus measured was about 100 times the linear expansion coefficient in the longitudinal direction.

Example 1

In Example 1, a winding core made of ABS resin (manufactured by Nippon Plastic Industries Co., Ltd.) having an outer diameter of 3 inches, a wall thickness of 6 mm, and a width of 10 mm was used as the winding core 1. The linear expansion coefficient α of the winding core 1 was $67.8\times10^{-6}$/K according to the following Formula (1). In the following formula (1), $r_{20°\ C.}$ is the radius (half of the outer diameter) of the winding core 1 when the environmental temperature is 20° C., and dr/dt is the slope of a straight line calculated from the measured values obtained by measuring the radius of the winding core 1 when the environmental temperature is changed to 0° C., 10° C., 20° C., 30° C., and 40° C.

$$\alpha = \frac{1}{r_{20°\ C.}}\frac{dr}{dt} \tag{1}$$

The Young's modulus E of the winding core 1 calculated by the following Formula (2) was 0.4 GPa. In the following Formula (2), Em is the Young's modulus of the winding core material (ABS resin), ν is the Poisson's ratio (ν=0.3), r is the radius (outer diameter) of the winding core 1, and t is the thickness of the winding core 1. The Young's modulus Em of the winding core material was calculated from the slope of compressive stress with respect to compressive strain in accordance with Japanese Industrial Standards (JIS K 7181 2011) "Plastics-Determination of Compressive Properties". Note that the test piece was a plate-like material having a length of 50 mm, a width of 10 mm, and a thickness of 4 mm collected from the winding core 1, and the test speed was 1 mm/min.

$$E = \frac{Em}{\dfrac{\left(\dfrac{r}{r-t}\right)^2+1}{\left(\dfrac{r}{r-t}\right)^2-1} - \nu} \tag{2}$$

Figure 2:
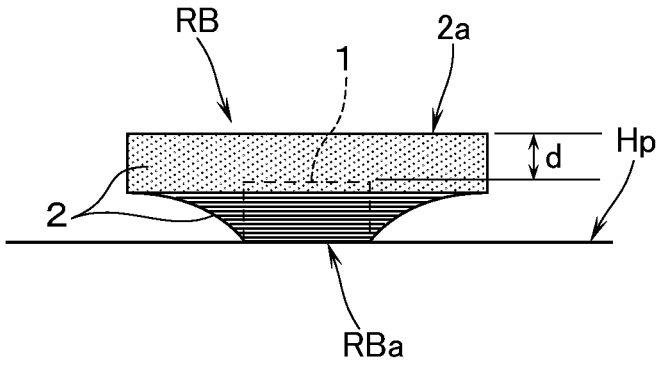
FIG. 2 is a diagram for explaining a method for determining a telescope phenomenon in Examples of the present invention.

An adhesive tape as the web 2 was cut into a width of 10 mm and wound around the winding core 1 at a winding length of 500 m under the conditions of a temperature of 25° C., a winding tension of 100 N/m, and a winding speed of 20 m/min to obtain the roll body RB. The roll body RB was stored in a room where the temperature (ambient temperature) was 45° C., and after a lapse of a predetermined time (after two days), the occurrence of the telescope phenomenon was suppressed. Here, as illustrated in FIG. 2, the roll body RB was placed such that a side surface RBa thereof was in contact with a horizontal surface Hp, and the shift amount d of the endmost surface in the width direction (upper surface in FIG. 2) 2*a* of the web 2 from the winding core 1 was calculated. In a case where the shift amount d was less than 5 mm, it was judged that the occurrence of the telescope phenomenon was suppressed, and in a case where the shift amount d was 5 mm or more, it was judged that the telescope phenomenon occurred.

Example 2

In Example 2, a roll body RB was obtained in the same manner as in Example 1 except that a winding core 1 made of ABS resin (manufactured by TOYO SHIKAN K.K.) having an outer diameter of 3 inches, a wall thickness of 6 mm, and a width of 10 mm was used. The linear expansion coefficient and the Young's modulus of the winding core 1 calculated in the same manner as in Example 1 were $41.1\times10^{-6}$/K and 0.4 GPa, respectively. The roll body RB obtained in Example 2 was stored for two days in the same manner as in Example 1, and the occurrence of the telescope phenomenon was suppressed.

Example 3

In Example 3, a roll body RB was obtained in the same manner as in Example 1 except that a winding core 1 made of ABS resin (manufactured by SHOWA MARUTSUTSU COMPANY, LTD.) having an outer diameter of 3 inches, a wall thickness of 6 mm, and a width of 10 mm was used. The linear expansion coefficient and the Young's modulus of the winding core 1 calculated in the same manner as in Example 1 were $73.4\times10^{-6}$/K and 0.4 GPa, respectively. The roll body RB obtained in Example 3 was stored for two days in the same manner as in Example 1, and the occurrence of the telescope phenomenon was suppressed.

Example 4

In Example 3, a roll body RB was obtained in the same manner as in Example 1 except that a winding core 1 made of high density polyethylene (HDPE) (manufactured by DAIKA POLYMERS Co., Ltd) having an outer diameter of 3 inches, a wall thickness of 7 mm, and a width of 10 mm was used. The linear expansion coefficient and the Young's modulus of the winding core 1 calculated in the same manner as in Example 1 were $82.7\times10^{-6}$/K and 0.2 GPa, respectively. The roll body RB obtained in Example 4 was stored for two days in the same manner as in Example 1, and the occurrence of the telescope phenomenon was suppressed.

Next, Comparative Examples with respect to Example 1 to 4 will be described.

Comparative Example 1

In Comparative Example 1, a roll body RB was obtained in the same manner as in Example 1 except that a winding core 1 made of ABS resin (manufactured by Nihon Plastic Kogyo K. K.) having an outer diameter of 3 inches, a wall thickness of 12 mm, and a width of 10 mm was used. The linear expansion coefficient and the Young's modulus of the winding core 1 calculated in the same manner as in Example 1 were $74.7\times10^{-6}$/K and 0.7 GPa, respectively. The roll body RB obtained in Comparative Example 1 was stored for two days in the same manner as in Example 1, and the telescope phenomenon occurred.

Comparative Example 2

In Comparative Example 2, a roll body RB was obtained in the same manner as in Example 1 except that a winding core 1 made of ABS resin (manufactured by Toto Sekisui Co., Ltd) having an outer diameter of 3 inches, a wall thickness of 8 mm, and a width of 10 mm was used. The linear expansion coefficient and the Young's modulus of the winding core 1 calculated in the same manner as in Example 1 were $76.9\times10^{-6}$/K and 0.6 GPa, respectively. The roll body RB obtained in Comparative Example 2 was stored for two days in the same manner as in Example 1, and the telescope phenomenon occurred.

Comparative Example 3

In Comparative Example 3, a roll body RB was obtained in the same manner as in Example 1 except that a winding core 1 made of ABS resin (manufactured by SHOWA MARUTSUTSU COMPANY, LTD.) having an outer diameter of 3 inches, a wall thickness of 12 mm, and a width of 10 mm was used. The linear expansion coefficient and the Young's modulus of the winding core 1 calculated in the same manner as in Example 1 were $82.7\times10^{-6}$/K and 0.6 GPa, respectively. The roll body RB obtained in Comparative Example 3 was stored for two days in the same manner as in Example 1, and the telescope phenomenon occurred.

Comparative Example 4

In Comparative Example 4, a roll body RB was obtained in the same manner as in Example 1 except that a winding core 1 made of PPT (manufactured by Shikoku Sekisui Co., Ltd) having an outer diameter of 3 inches, a wall thickness of 8 mm, and a width of 10 mm was used. The linear expansion coefficient and the Young's modulus of the winding core 1 calculated in the same manner as in Example 1 were $49.9\times10^{-6}$/K and 0.8 GPa, respectively. The roll body RB obtained in Comparative Example 4 was stored for two days in the same manner as in Example 1, and the telescope phenomenon occurred.

Comparative Example 5

In Comparative Example 5, a roll body RB was obtained in the same manner as in Example 1 except that a winding core made of ABS resin having an outer diameter of 3 inches, a wall thickness of 6 mm, and a width of 10 mm, and having a linear expansion coefficient of $30.0\times10^{-6}$/K and a Young's modulus of 0.8 GPa was used as a winding core 1. The roll body RB was stored for two days in the same manner as in Example 1, and the telescope phenomenon occurred.

Comparative Example 6

In Comparative Example 6, a roll body RB was obtained in the same manner as in Example 1 except that a winding core made of ABS resin having an outer diameter of 3 inches, a wall thickness of 6 mm, and a width of 10 mm, and having a linear expansion coefficient of $20.0\times10^{-6}$/K and a Young's modulus of 0.8 GPa was used as a winding core 1. The roll body RB was stored for two days in the same manner as in Example 1, and the telescope phenomenon occurred.

Comparative Example 7

In Comparative Example 7, a roll body RB was obtained in the same manner as in Example 1 except that a winding core made of ABS resin having an outer diameter of 3 inches, a wall thickness of 6 mm, and a width of 10 mm, and having a linear expansion coefficient of $40.0\times10^{-6}$/K and a Young's modulus of 0.6 GPa was used as a winding core 1. The roll body RB was stored for two days in the same manner as in Example 1, and the telescope phenomenon occurred.

Comparative Example 8

In Comparative Example 8, a roll body RB was obtained in the same manner as in Example 1 except that a winding core made of ABS resin having an outer diameter of 3 inches, a wall thickness of 6 mm, and a width of 10 mm, and having a linear expansion coefficient of $120.0\times10^{-6}$/K and a Young's modulus of 0.4 GPa was used as a winding core 1. The roll body RB was stored for two days in the same manner as in Example 1, and the telescope phenomenon occurred.

Figure 3:
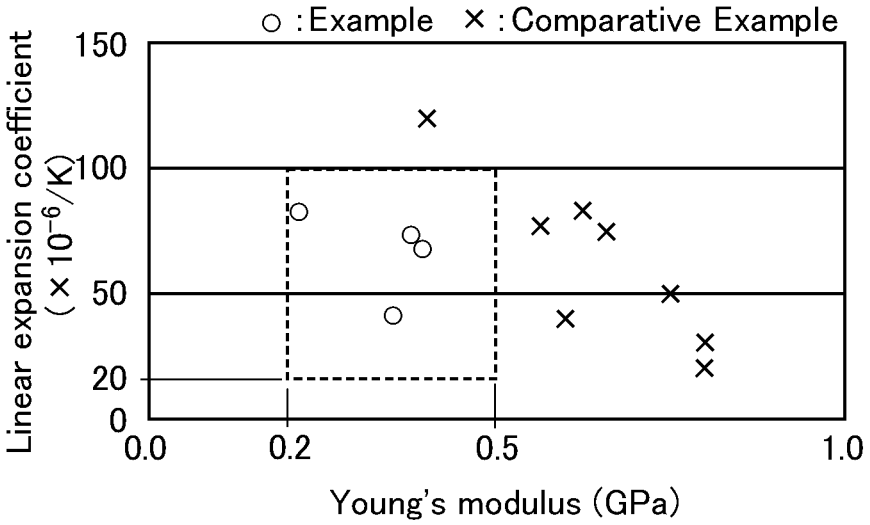
FIG. 3 is a graph for explaining a method for determining a telescope phenomenon in Examples and Comparative Examples of the present invention.

According to Examples 1 to 4 and Comparative Examples 1 to 8 described above, as illustrated in FIG. 3, it has been found that the occurrence of the telescope phenomenon can be effectively suppressed by using a winding core having a linear expansion coefficient in the range of $20\times10^{-6}$/K to $100\times10^{-6}$/K (preferably $40\times10^{-6}$/K to $90\times10^{-6}$/K, more preferably $41\times10^{-6}$/K to $83\times10^{-6}$/K) and a Young's modulus in the range of 0.2 GPa to 0.5 GPa (preferably 0.2 GPa to 0.4 GPa) as the winding core 1.

Although the embodiment and examples of the present invention have been described above, various modifications can be made without departing from the scope of the technical idea of the present invention. In Examples 1 to 4, the case of using the adhesive tape in which the pressure-sensitive adhesive layer is formed on one surface of the polyimide film as the web 2 has been described as an example; however, since this pressure-sensitive adhesive layer does not contribute to the linear expansion coefficient of the web 2, a plastic film alone can be used as the web 2. The plastic film is not limited to a polyimide film, and a film having a linear expansion coefficient in the thickness direction in a range of 60 to 150 times a linear expansion coefficient in the longitudinal direction can be used as the web 2.

REFERENCE SIGNS LIST

RB roll body
1 winding core, core
2 web

The invention claimed is:

1. A roll body configured by winding a belt-shaped web around a winding core that thermally expands or contracts due to an influence of a surrounding environment, the roll body characterized in that a linear expansion coefficient of the belt-shaped web in a thickness direction is in a range of 60 to 150 times a linear expansion coefficient of the belt-shaped web in a longitudinal direction, and the winding core has a linear expansion coefficient in a range of $20\times10^{-6}$/K to $100\times10^{-6}$/K and a Young's modulus in a range of 0.2 GPa to 0.5 GPa.

2. The roll body according to claim 1, wherein the belt-shaped web is a polyimide film having a width of 5 mm to 100 mm.

* * * * *